US005344357A

United States Patent [19]

Lyczek

[11] Patent Number: 5,344,357

[45] Date of Patent: Sep. 6, 1994

[54] CONTROLLABLE AQUATIC TOY WITH OSCILLATING AND STEERABLE TAIL

[76] Inventor: Edmund K. Lyczek, 428 Quail Ridge Cir., Spartanburg, S.C. 29303

[21] Appl. No.: 131,005

[22] Filed: Oct. 4, 1993

[51] Int. Cl.[5] ..... A63H 23/04; A63H 23/00

[52] U.S. Cl. ..... 446/154; 446/158

[58] Field of Search ..... 446/153, 154, 156–158, 446/160–164

[56] References Cited

U.S. PATENT DOCUMENTS

| | | | |
|---|---|---|---|
| 3,628,286 | 12/1971 | Mashahiro | 446/158 |
| 3,785,084 | 1/1974 | Aenishanslin | 446/158 |
| 4,068,401 | 1/1978 | Saitoh | 446/158 |
| 4,241,535 | 12/1980 | Tsukuda | 446/162 |
| 4,832,650 | 5/1989 | Tong | 446/156 |

*Primary Examiner*—Robert A. Hafer
*Assistant Examiner*—Jeffrey D. Carlson

[57] ABSTRACT

An aquatic toy constructed of a flexible, watertight body, shaped and decorated to resemble an aquatic animal, having a head, a carcass, and a tail. The toy has a first motor constructed and arranged for driving the tail in an oscillating manner to propel the toy while in water, a second motor constructed and arranged for swinging the tail off the center line of the toy to steer the toy, and a control system constructed and arranged for switching on/off the first and second motors under certain conditions. The toy further has an air ballast container constructed and arranged for maintaining the toy almost but not completely submerged when the toy is placed in water.

6 Claims, 2 Drawing Sheets

CONTROLLABLE AQUATIC TOY WITH OSCILLATING AND STEERABLE TAIL

BACKGROUND OF THE INVENTION

The present invention relates to toys devised and designed to be used in an ambient of water.

A general objective of the present invention is to provide an improved toy which resembles an aquatic animal in shape and behavior.

SUMMARY OF THE INVENTION

According to the present invention there is provided an aquatic toy constructed of a flexible, watertight body, shaped and decorated to resemble an aquatic animal i.e. fish, having a head, a carcass, and a tail. Said toy comprising a first motor constructed and arranged for driving the tail in an oscillating manner to propel the toy while in water, a second motor constructed and arranged for swinging the tail off the center line of the toy to steer the toy, a control system constructed and arranged for switching on/off said first and second motors under certain conditions, an air ballast container constructed and arranged for maintaining the toy almost but not completely submerged when the toy is placed in water, and a rechargeable battery to power said first and second motors and the control system.

DESCRIPTION OF THE PREFERRED EMBODIMENT

Figure 1:
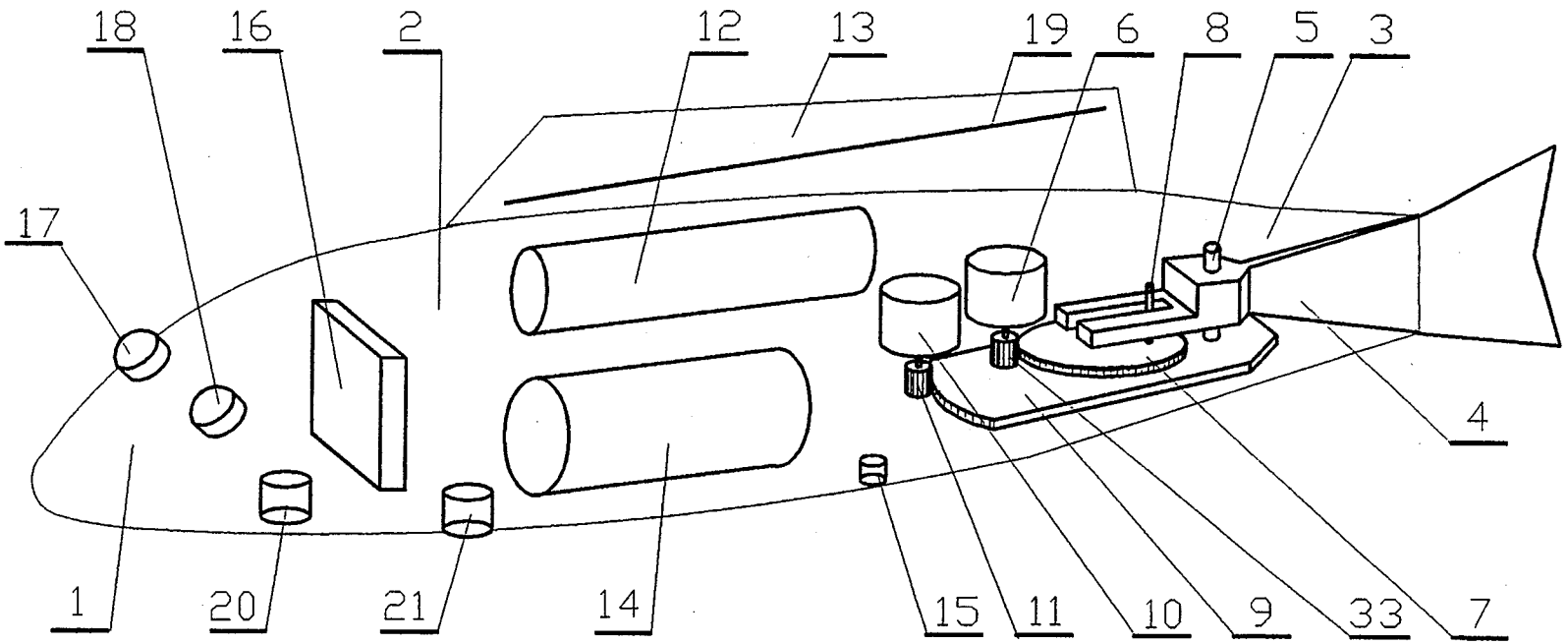
FIG. 1 is a diagramatic view of the toy.

Referring to FIG. 1 a flexible, watertight body having a head 1, a carcass 2, and a tail 3 is shaped and decorated to resemble a fish. The tail 3 has flexible insert 4 mounted pivotally on an axle 5. The outer end of the flexible insert 4 is shaped as a fish tail fin. The inner end of the flexible insert 4 has a slot which is coupled mechanically to a gear 7 via a pin 8 located eccentrically on the gear 7. The gear 7 is meshed with a pinion 33 installed on the shaft of the first motor 6. While the first motor 6 is energized, the gear 7 is rotating thus, the flexible insert 4 is driven by the pin 8 in an oscillating manner. The first motor 6, and the gear 7 with the pin 8 are mounted on a common plate 9 located inside the toys carcass 2. The plate 9 which is mounted pivotally on the axle 5 has part of its edge shaped as a part of a gear meshed with a pinion 11 installed on the shaft of the second motor 10. By energizing the second motor 10 the plate 9 together with mounted on it the first motor 6, and the gear 7 can be pivoted off the center line of the toy while the tail is oscillating thus, the toy can be steered.

Inside the top part of the carcass 2 is located the air ballast container 12 which purpose is to maintain the toy almost but not completely submerged, so the back fin 13 would be always above the water surface and the toy would take proper horizontal position.

In the middle part of the carcass 2 the rechargeable battery 14 is located. The purpose of the battery 14 is to power the first motor 6, the second motor 10 and the control system of the toy. The battery 14 is sealed inside the toy's body, but it can be recharged via connector 15 located in the lower part of the carcass 2.

The control system is located inside the carcass 2, but some of its parts are placed on the surface or near to the surface of the toy.

Figure 2:
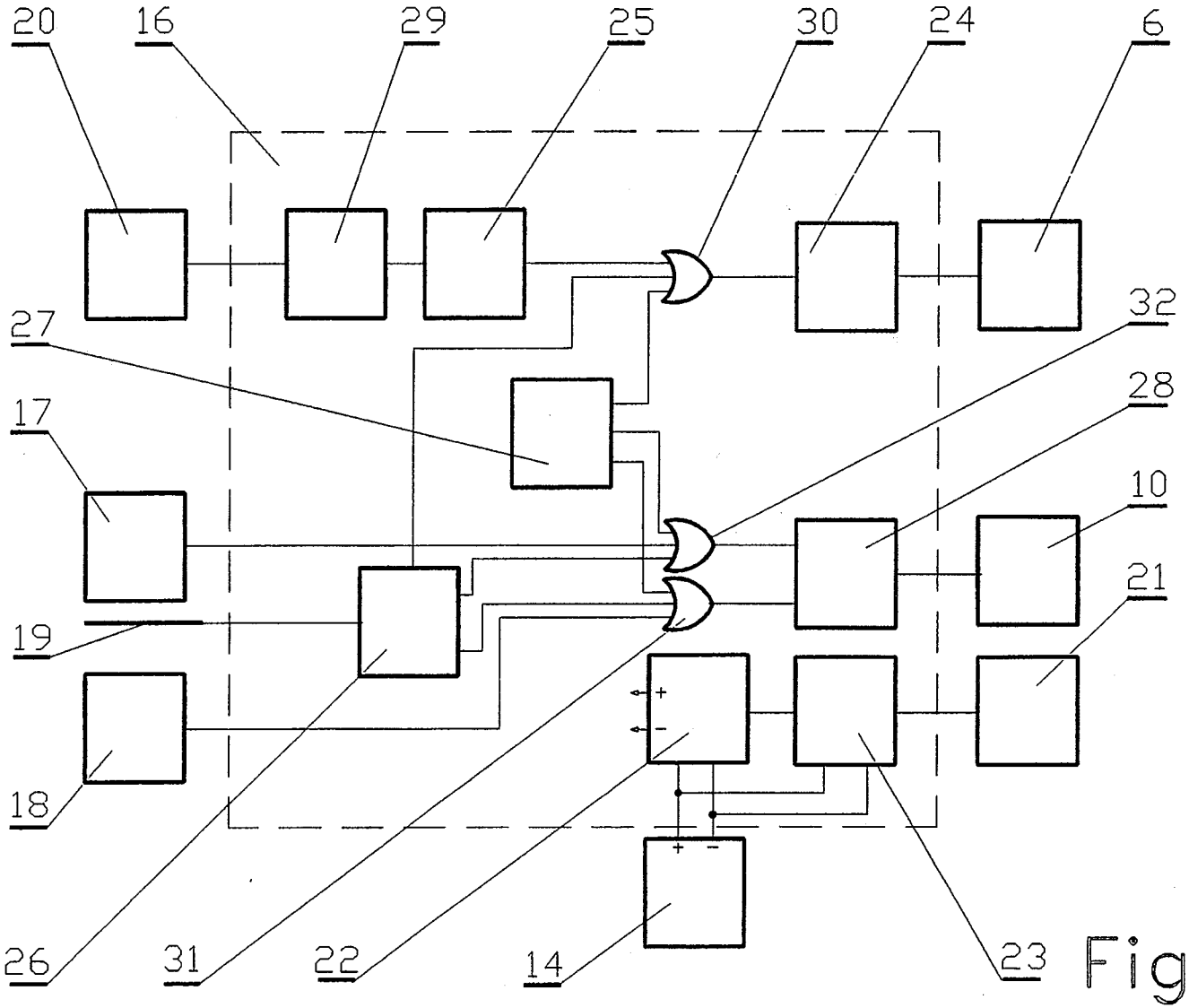
FIG. 2 is a block diagram of the control system.

In particular, the proximity sensors 17, 18 are located in the head 1 in places where a fish has eyes, the antenna 19 is located inside the back fin 13, the microphone 20 and the water sensor probes 21 are located in the lower part of the carcass 2, and the electronic circuitry 16 is located inside the toy's carcass 2. Referring now to FIG. 2 and FIG. 1, the control system comprises four sensors and electronic circuitry located and sealed in particular areas of the toy's body.

The electronic circuitry 16 of the control system consists of: a first switch 22, a water sensor 23, second switch 24, a timer 25, a radio controller 26, a random controller 27, reversible switch 28, a sound sensor 29 and three input OR gates 30, 31, 32. The radio remote controller 26 has three channels remotely operable with the help of a transmitter similar to one commonly used to control toys. Its first channel whose output is connected to the second input of the OR gate 30 can be activated independently from the other channels. The second and third channels whose outputs are connected to the second inputs of the OR gates 31, 32 respectively, can be activated alternately. Signal from the first channel is to switch on/off the first motor 6 via the OR gate 30 and the second switch 24. Signals from the second or third channels switch on/off the second motor 10 via OR gates 31 or 32 and reversible switch 28.

With the radio remote controller 26 the user is able to take over the control any time and bring the toy to the desired spot. The purpose of the random controller 27 is to control the toy while it is not under radio remote control.

At that time, thanks to the random controller 27, the toy is able to move and change direction by itself in an unpredicted way. The first switch 22 which turns on power to the whole control system (except to the water sensor 23) is controlled by a signal from the water sensor 23.

The water sensor 23, permanently powered by battery 14 has its probes 21 located on lower part of the toys carcass 2 and its output connected to the input of the first switch 22. When the toy is placed in water, the signal from the water sensor 23 turns on the switch 22 thus, the control system 16 is powered and the toy becomes operative. Removing the toy from the water causes the water sensor 23 to turn off the switch 22 thus, to disconect power to the control system.

The first motor 6 which drives the toy's tail 4 is powered by the battery 14 via the second switch 24, which input is connected to the output of three input OR gate 30.

First input of the OR gate 30 is connected to the output of the timer 25, second input is connected to the output of the radio controller 26, and third input is connected to the random controller 27.

The second switch 24 can be turned on independently by a signal on each input of the OR gate 30 thus, the toy can be put to motion remotely by the radio controller 26, or by a signal from the random controller 27, or by a signal from the timer 25. The timer 25 has its input connected to the output of the sound sensor 29 whose input is connected to the microphone 20.

At certain sound level, the signal from the sound sensor 29 activates the timer thus, for preset period of time (couple of seconds) the toy is put to motion, so it behaves like real fish which responds to the sound by swimming away.

The random controller 27 consists of a random generator and logic circuitry with three outputs driven by said random generator. The first output signal is to switch on/off the first motor 6 via the OR gate 30 and the second switch 24 as described above, so the toy is put to motion only from time to time for a couple of seconds. This makes the toy's movement similar to the movement of the real fish, and also preserves the battery. The purpose of the other two output signals is to change the course of the toy while in motion by energizing the second motor 10 in one or the other direction via one of OR gates 31 or 32 and the reversible switch 28.

The reversible switch 28 has two inputs connected to outputs of the OR gates 31, 32 respectively, for switching power from battery 14 to the second motor 10, as well for reversing its polarity.

The first inputs of the OR gates 31, 32 are connected to the outputs of the random controller 27, and the second inputs of said OR gates 31, 32 are connected to the radio remote controller 26 respectively.

The third input of the OR gate 31 is connected to the output of the left proximity sensor 18, while the third input of the OR gate 32 is connected to the output of the right proximity sensor 17. The purpose of the proximity sensors 17, 18 is to enable the toy to detect objects in front of it and to change its course just to avoid a collision with said objects.

When the right proximity sensor 17 detects an object, its output signal turns on the reversible switch 28, so the second motor 10 being energized swings the tail 3 off the center line of the toy to the left thus, the toy changes its course by making a left turn not to collide with said object. When the left proximity sensor 18 detects an object, its output signal turns on the reversible switch 28 while reversing direction of the electric current of the second motor 10 thus, the toy changes its course by making a right turn.

I claim:

1. An aquatic toy constructed of a flexible, watertight body, shaped and decorated to resemble an aquatic animal, having a head, a carcass, and a tail comprising:

a first motor constructed and arranged for driving the tail in an oscillating manner to propel the toy while in water;

a second motor constructed and arranged for swinging the tail off the center line of the toy for the purpose to steer the toy;

a control system constructed and arranged for switching on/off said first and second motors under certain conditions;

an air ballast container constructed for maintaining the toy almost but not completely submerged when the toy is placed in water;

and a rechargeable battery to power said first and second motors and the control system.

2. A control system according to claim 1 comprising:

a water sensor having a pair of sensing probes placed on the toy's surface and an electronic circuitry placed inside the toy's body, permanently connected to the rechargeable battery;

a first switch controlled by signal from said water sensor constructed and arranged for switching power to the first and second motors and the control system (except to the water sensor) only when the toy is placed in the water.

3. A control system according to claim 1 further comprising:

a second switch constructed and arranged for switching power to the first motor;

a sound sensor having an electronic circuitry placed inside the toy's body and a microphone placed inside but close to the surface of the toy's body;

a timer activated by a signal from the sound sensor having an output signal turned on for a preset period of time wherein the output signal from said timer controls the first motor via the second switch.

4. A control system according to claim 1 further comprising:

a radio remote controller having three remotely operable channels;

a reversible switch constructed and arranged for switching power to the second motor to run the motor in both directions wherein said reversible switch is controlled by output signals of the three from two said remotely operable channels respectively, while signal from the third remotely operable channel controls a second switch constructed and arranged for switching power to the first motor.

5. A control system according to claim 4 further comprising a random controller having a random generator and logic circuitry with three outputs driven by said random generator wherein signals from the second and third outputs control the reversible switch while the first output controls the second switch.

6. A control system according to claim 1 further comprising a first proximity sensor and second proximity sensor constructed and arranged to detect objects in the front of the toy wherein signals from said proximity sensors control the second motor via a reversible switch respectively, in order to prevent the toy from colliding with said objects.

* * * * *